United States Patent [19]

Dineen, deceased

[11] Patent Number: 4,476,681

[45] Date of Patent: Oct. 16, 1984

[54] BALANCE FREE-PISTON HYDRAULIC PUMP

[75] Inventor: John J. Dineen, deceased, late of Durham, N.H., by Gertrude D. Dineen, administratrix

[73] Assignee: Mechanical Technology Incorporated, Latham, N.Y.

[21] Appl. No.: 354,019

[22] Filed: Mar. 2, 1982

[51] Int. Cl.[3] ..... F02G 1/04

[52] U.S. Cl. ..... 60/486; 60/484; 60/520; 417/338; 417/383

[58] Field of Search ..... 60/517, 519, 520, 525, 60/484, 486; 417/383, 338

[56] References Cited

U.S. PATENT DOCUMENTS 3,100,965 8/1963 Blackburn ..... 91/4 X 3,811,283 5/1974 Hartmann et al. ..... 60/525 X

*Primary Examiner*—Allen M. Ostrager

*Attorney, Agent, or Firm*—Joseph V. Claeys; Arthur N. Trausch, III

[57] ABSTRACT

A four piston hydraulic pump driven by a four cylinder free-piston Stirling engine has four stepped pistons operating out of phase in pairs. The hydraulic fluid pumped between the hydraulic cylinder can be tapped for hydraulic power. The stepped pistons give the option of utilizing low flow/high pressure, or high flow/-low pressure. The non-utilized flow ensures that the timing between pistons will always remain correct. Since the arrangement is symmetrical, it remains balanced.

4 Claims, 2 Drawing Figures

BALANCE FREE-PISTON HYDRAULIC PUMP

FIELD OF THE INVENTION

The present invention relates to a pump for hydraulic fluid, particularly one which utilizes the output of a Stirling engine for hydraulic power.

BACKGROUND OF THE INVENTION

Presently there has become a renewed interest in the Stirling engine particularly with regard to its use in varying applications. A basic Stirling engine design, particularly with regard to the well known free-piston Stirling engine for example, involves the cycle of compressing a gas enclosed in a chamber at a low temperature and transporting or conveying the gas to a high temperature working chamber with the gas being heated and allowed to expand, with such expansion resulting in the generation of mechanical work. The gas is then transferred back to the low temperature chamber and the cycle repeats. In such a free-piston design, the expanding gas pressure wave deflects a mechanical device such as a flexible diaphragm or bellow which in turn displaces hydraulic fluid which in turn may be used to displace a piston. The displacement of the piston is in the form of mechanical work and can be used for a multitude of purposes, which in the present application would be to provide power for hydraulic pumping.

Heretofore, there has been provided a pumping unit for hydraulic fluid for use in conjunction with a Stirling engine which utilizes the energy existing in its cycle. However, such pumping units tended to upset the balancing and synchronization of operation of the engine or are otherwise undesirable for reasons particular to their application.

SUMMARY OF THE INVENTION

Accordingly, it is an object of the invention to provide for a hydraulic fluid pumping unit which can be effectively utilized in a free-piston Stirling engine without upsetting the engines balance or its synchronization of operation.

The present invention provides for the nesting of four Stirling free-piston engines straddled 90° to each other and in association with four mechanical devices or displacers such as flexible diaphragms or bellows which displace a hydraulic fluid as a result of the expanding gas pressure wave which deflects the mechanical device, which as aforenoted, results in piston movement. The pistons are symmetrically positioned to cancel any induced axial forces and moment, advantageously restricting the need for other engine balancing systems.

Moreover, the four pistons are linked together by way of a hydraulic fluid connection which arrangement serves to advantageously synchronize the operation of the engine since the hydraulic linkage forces the work out of each cylinder, thereby simplifying the control of the engine since no one cylinder can "run away" or "act out of phase" with the others.

BRIEF DESCRIPTION OF THE DRAWINGS

These and other objects and advantages will be realized by the present invention, the description of which should be taken in conjunction with the drawings wherein.

DETAILED DESCRIPTION OF THE PREFERRED EMBODIMENT

Figure 1:
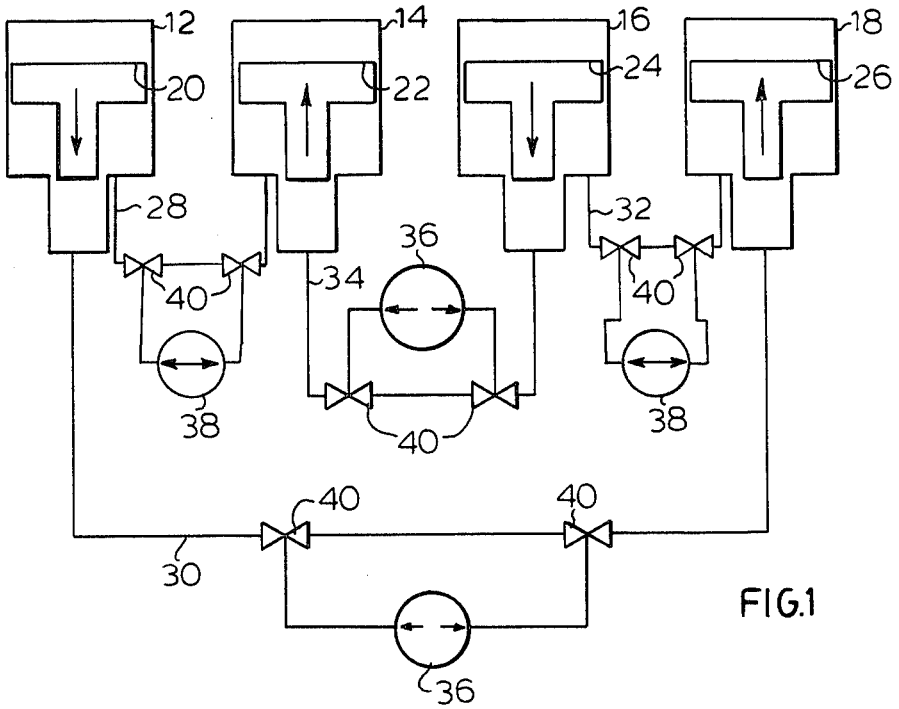
FIG. 1 is a somewhat schematic representation of a four piston arrangement for the hydraulic pump, incorporating the teachings of the present invention.
Figure 2:
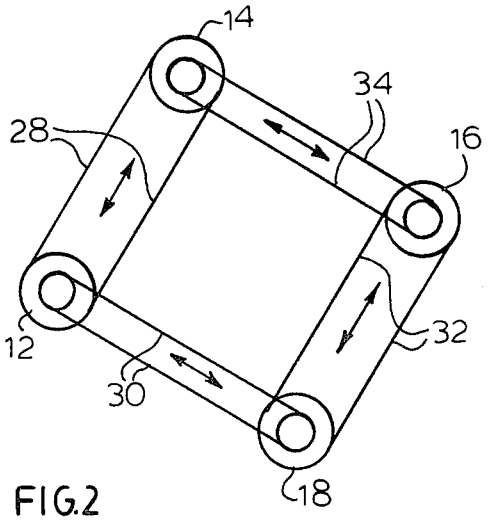
FIG. 2 is a somewhat schematic top view representation of the four piston arrangement for the hydraulic pump showing the 90° nesting and the hydraulic connections, incorporating the teachings of the present invention.

With reference now to FIG. 1, there is shown a somewhat schematic representation of the hydraulic pump generally designated by the numeral 10. It should be initially understood that this pump 10 is intended to be incorporated into a Stirling engine and powered thereby. In this regard, each of the cylinders 12, 14, 16 and 18 and their respective pump pistons 20, 22, 24 and 26 are part of respective four Stirling free-piston engines including four mechanical deflecting devices. These four cylinders are nested 90° with respect to one another as shown in FIG. 2, with the engines operating in the representative manner aforenoted. That being, the expanding gas pressure wave in each engine's operation serves to deflect a flexible diaphragm or bellow which serves to displace hydraulic fluid. The respective displacements of a constant volume fluid will serve, in the present situation, to drive respective pairs of pistons 180° out of phase between the pairs, as will be apparent. FIG. 1 shows only the hydraulic pump portion of the piston-cylinder arrangement. The pump pistons 20–26 would be part of or coupled to respective pistons of the respective engines which would be displaced in a manner aforenoted, thus displacing their respective pump pistons.

As shown in the figures, the respective cylinders have hydraulic connections between them wherein the hydraulic fluid driven between the cylinders can be tapped to supply hydraulic power. Each of the four cylinders 12–18 are provided with two bores, the first of which is of a large diameter and the second of which is of a relatively smaller diameter. The pump pistons provided in the respective cylinders are stepped to correspond to the shape of the cylinders and in the cylinder serves to form a large diameter chamber and smaller diameter chamber as shown in FIG. 1. Note that appropriate sealing means should be utilized between the pump pistons 12–18 and the respective portions of their cylinders to maintain the separate integrity of the chambers formed.

By such an arrangement, the user is provided with the option of utilizing a low flow/high pressure or high flow/low pressure as the source of the hydraulic output which would be taken from the respectively formed small chamber and large chamber of the cylinders 12–18.

As shown in FIG. 1, the larger diameter portion of piston 20 pumps reciprocally with the respective portion of piston 22 in cylinder 14 via hydraulic connection 28. The smaller diameter portion of piston 20 pumps reciprocally with the smaller diameter portion of piston 26 in cylinder 18 via hydraulic line connection 30. The large diameter portion of piston 24, which is synchronized with piston 20 due to the connection via piston 22, pumps reciprocally with the respective portion of piston 26 via hydraulic connection 32 with the smaller diameter portion of pistons 24 and 22 also connected via hydraulic connection 34. As shown, the hydraulic power can be taken from the connections 28 and 32 between cylinders 12 and 14; 16 and 18, for high flow/-low pressure and the connections 30 and 34 between cylinders 12 and 18; 14 and 16 for low flow/high pressure.

In this regard, these lines 28–34 (while interrelated, 32 and 34 might be considered primary and for balancing; 28 and 30 might be considered secondary and for synchronization) can be tapped off and coupled to supply hydraulic power to any number of devices, which have been generally designated by the numeral 36 for the high pressure region and 38 for the low pressure region, during reciprocating movement of the pump pistons, along with appropriate check valves 40, as desired.

As is readily apparent by the foregoing, the present arrangement since it is symmetrical it reduces or eliminates the need for counter balancing since there is provided a balancing scissor motion of the opposing pistons and forces i.e., pistons 20 and 24 in the same direction and pistons 22 and 26 in the opposite direction which serves to cancel induced axial forces and moment.

The hydraulic flow between the cylinders provides for self synchronization, forcing the work out of the cylinders preventing run away or loss of phase. With only one hydraulic power take off, the remaining non-utilized flow ensures that the timing between the pump pistons and the Stirling engines always remains synchronized.

Thus by the aforenoted invention the aforenoted objects and advantages and others are realized, and although a preferred embodiment has been disclosed and described in detail herein, its scope should not be limited thereby rather its scope should be determined by that of the appended claims.

What is claimed is:

1. A hydraulic pump for use in association with a four cylinder free-piston Stirling engine to provide a power output thereto, said pump comprising:

at least four displaceable pump pistons disposed in respective cylinders and symmetrically arranged so as to maintain pump balance;

synchronizing means which includes hydraulic connection means between the respective pump piston cylinders whereby hydraulic fluid is pumped through said connecting means due to displacement of the pump pistons in their cylinders which can be tapped as a source of hydraulic power, while providing that the pump pistons operate in pairs that are displaced 180° out of phase of each other; and said pump pistons and cylinders are formed so as to provide a low flow/high pressure situation at one point in the cylinder coupled to the connecting means and a high flow/low pressure situation at the other point in the cylinder coupled to the connecting means with said situations created by the respective pump pistons reciprocal displacement in respective cylinders, and allows tapping off of either situation as a source of hydraulic power.

2. The hydraulic pump in accordance with claim 1 wherein said pump pistons are formed in a step like fashion, having a large diameter portion and a smaller diameter portion, the respective cylinders include a portion having a first internal diameter operatively accommodating the large diameter portion to create the high flow/low pressure situation and a second internal diameter operative accommodating the smaller diameter portion to create the low flow/high pressure situation.

3. The hydraulic pump in accordance with claims 1 or 2 wherein said synchronization is provided by hydraulic connections between the low flow/high pressure situation of: a first and second cylinder; a third and fourth cylinder; and providing a hydraulic connection between the high flow/low pressure situations of: the first and third cylinders; the second and fourth cylinders.

4. A hydraulic pump for use in association with a four cylinder free-piston Stirling engine to provide a power output thereto, said pump comprising:

at least four displaceable pump pistons disposed in respective cylinders and symmetrically arranged in a square like manner with respective pump pistons disposed at the corners of the square and the respective pump pistons in each pair being diagonally disposed with respect to each other so as to maintain pump balance; and synchronizing means which includes hydraulic connection means between the respective pump piston cylinders whereby hydraulic fluid is pumped through said connecting means due to displacement of the pump pistons in their cylinders which can be tapped as a source of hydraulic power, while providing that the pump pistons operate in pairs that are displaced 180° out of phase of each other.

* * * * *